US011690778B2

(12) United States Patent
Furutani

(10) Patent No.: US 11,690,778 B2
(45) Date of Patent: Jul. 4, 2023

(54) CHAIR-TYPE MASSAGE MACHINE AND MASSAGE MACHINE

(71) Applicant: Fuji Medical Instruments Mfg. Co., Ltd., Osaka (JP)

(72) Inventor: Takeshi Furutani, Osaka (JP)

(73) Assignee: Fuji Medical Instruments Mfg. Co., Ltd., Osaka (JP)

( * ) Notice: Subject to any disclaimer, the term of this patent is extended or adjusted under 35 U.S.C. 154(b) by 150 days.

(21) Appl. No.: 16/775,062

(22) Filed: Jan. 28, 2020

(65) Prior Publication Data

US 2020/0390640 A1 Dec. 17, 2020

(30) Foreign Application Priority Data

Jun. 14, 2019 (JP) ..... 2019-111175
Jun. 14, 2019 (JP) ..... 2019-111177

(51) Int. Cl.
*A61H 9/00* (2006.01)
*A61H 7/00* (2006.01)

(52) U.S. Cl.
CPC ..... *A61H 9/0078* (2013.01); *A61H 7/007* (2013.01); *A61H 2201/0149* (2013.01); *A61H 2201/0207* (2013.01); *A61H 2203/0431* (2013.01); *A61H 2205/06* (2013.01); *A61H 2205/081* (2013.01)

(58) Field of Classification Search
CPC ..... A61H 2003/006; A61H 2205/06; A61H 2201/0149; A61H 9/0078; A61H 2203/0431; A61H 2205/081; A61H 2201/0192; A61H 7/007; A61H 2201/0207; A61H 2201/0138; A63B 2208/0233; B60N 2/976; B60N 2/75; A47C 1/00; A47C 1/03; A47C 1/0308; A47C 7/54; A47C 7/68
See application file for complete search history.

(56) References Cited

U.S. PATENT DOCUMENTS 6,003,940 A 12/1999 Jackson
8,845,560 B1 * 9/2014 Hernandez ..... A61H 1/0281 601/24
10,729,611 B2 * 8/2020 Ode ..... A61H 15/0078
10,966,899 B2 * 4/2021 Ode ..... A61H 9/0078
10,966,901 B2 * 4/2021 Masuda ..... A61H 9/0078
(Continued)

FOREIGN PATENT DOCUMENTS

CN 203000089 U 6/2013
CN 106214445 A * 12/2016 ..... A61H 15/0078
(Continued)

OTHER PUBLICATIONS

Machine translation of description and claims for CN106144485A published 2016.*
(Continued)

*Primary Examiner* — Philip R Wiest
*Assistant Examiner* — Tyler A Raubenstraw
(74) *Attorney, Agent, or Firm* — Masuvalley & Partners; Peter R. Martinez

(57) ABSTRACT

A chair-type massage machine includes a seat portion, a backrest portion that is reclinable rearward of the seat portion, and a forearm treatment portion that treats each of forearms of a person to be treated. The forearm treatment portion is mounted to each of both left and right side surfaces of the backrest portion.

5 Claims, 15 Drawing Sheets

(56) References Cited

U.S. PATENT DOCUMENTS

2002/0068887 A1* 6/2002 Kikumoto ..... G16H 40/63 601/57
2003/0139693 A1* 7/2003 Swift ..... A61G 15/00 601/49
2005/0146176 A1* 7/2005 Yoda ..... A61H 9/0071 297/217.1
2006/0142676 A1* 6/2006 Fujii ..... A61H 7/007 601/99
2007/0120408 A1* 5/2007 Hsieh ..... A47C 1/03294 297/411.39
2008/0048475 A1* 2/2008 Tanizawa ..... A61H 23/04 297/284.6
2008/0132383 A1* 6/2008 Einav ..... A61H 23/0263 482/8
2009/0099489 A1* 4/2009 Tanizawa ..... A61H 9/0078 601/134
2009/0254011 A1* 10/2009 Chi ..... A61H 23/02 601/134
2010/0145245 A1* 6/2010 Chen ..... A61H 9/0078 601/149
2010/0312155 A1* 12/2010 Fukuyama ..... A61H 9/0078 601/98
2012/0157898 A1* 6/2012 Watanabe ..... A61H 9/0078 601/148
2012/0157899 A1* 6/2012 Terada ..... A61H 9/0078 601/149
2014/0159454 A1* 6/2014 Furutani ..... A47C 1/035 297/341
2015/0366746 A1 12/2015 Ashby
2016/0183686 A1* 6/2016 DiPaolo ..... B60N 2/75 297/411.1
2016/0317378 A1* 11/2016 Fujishiro ..... A61H 9/0078
2019/0231634 A1* 8/2019 Inada ..... A61H 7/004
2020/0229998 A1* 7/2020 Paz ..... A61G 5/1067

FOREIGN PATENT DOCUMENTS

DE 19960517 A1 * 11/2000 ..... A61H 9/0078
EP 1884225 A1 * 2/2008 ..... A61H 1/003
JP H04-093647 U 8/1992
JP H11-113675 A 4/1999
JP 2001314471 A 11/2001
JP 2006087571 A 4/2006
JP 2006333983 A 12/2006
JP 2012125650 A 7/2012
TW M405863 U 6/2011

OTHER PUBLICATIONS

Written description and claims machine translated for CN106214445A (Year: 2016).*

Machine translation of claims and description for DE19960517A1 (Year: 2000).*

Office Action/JPO, Notice of Reasons for Refusal dated Feb. 7, 2023, in Japanese Patent Application No. 2019-111175, 8 pages with translation.

Office Action/JPO, Notice of Reasons for Refusal dated Feb. 7, 2023, in Japanese Patent Application No. 2019-111177, 7 pages with translation.

Office Action/CNIPA, Chinese Office Action dated May 9, 2023 in Chinese Patent Application No. 202010068123.4, 10 pages with translation.

* cited by examiner

CHAIR-TYPE MASSAGE MACHINE AND MASSAGE MACHINE

RELATED APPLICATIONS

This nonprovisional application claims priority under 35 U.S.C. § 119(a) on Patent Application No. 2019-111175 filed in Japan on Jun. 14, 2019 and Patent Application No. 2019-111177 filed in Japan on Jun. 14, 2019, the entire contents of which are hereby incorporated by reference.

BACKGROUND OF THE INVENTION

Field of the Invention

The present invention relates to a chair-type massage machine including a forearm treatment portion and to a massage machine that is capable of treating a person to be treated when installed on an existing chair.

Description of the Related Art

Conventionally, chair-type massage machines have been variously developed, which each include a forearm treatment portion disposed at each of armrest portions thereof (see, for example, Japanese Patent Application Publication No. 2006-87571).

In the chair-type massage machine proposed in Japanese Patent Application Publication No. 2006-87571, the forearm treatment portion is capable of treating each of forearms of a person to be treated only when the person to be treated places the forearms on the armrest portions. Hence, the forearm treatment portion is capable of treating each of the forearms of the person to be treated only in a state where elbow joints of the person to be treated are bent. That is, in the chair-type massage machine proposed in Japanese Patent Application Publication No. 2006-87571, the forearm treatment portion is not capable of treating each of the forearms of the person to be treated in a state where the elbow joints of the person to be treated are extended (a state where arms of the person to be treated are relaxed).

Furthermore, in a case where a reclining function is additionally imparted to the chair-type massage machine proposed in Japanese Patent Application Publication No. 2006-87571, when a backrest portion is reclined, the forearms of the person to be treated are moved rearward with respect to a seat portion and the armrest portions, so that treatment positions (at which massage is applied) on the forearms of the person to be treated are undesirably displaced from intended positions toward wrists of the person to be treated.

In the chair-type massage machine proposed in Japanese Patent Application Publication No. 2012-125650, the above-described displacement can be reduced by a mechanism for synchronizing reclining of the backrest portion with a rearward movement of the forearm treatment portion. The mechanism for synchronizing reclining of the backrest portion with a rearward movement of the forearm treatment portion, however, has a complex structure and hence might lead to a substantial increase in weight and cost of the massage machine.

Furthermore, conventionally, massage machines have been variously developed, which are each capable of treating a person to be treated when installed on an existing chair (see, for example, FIG. 14 of Japanese Patent Application Publication No. 2001-314471). This type of massage machine has a seat-like outer shape and thus is referred to as a "seat massager."

Furthermore, conventionally, massage machines have been variously developed, which each include a treatment unit that is capable of treating each of forearms of a person to be treated when wrapped around the each of forearms of the person to be treated (see, for example, paragraph [0002] in Japanese Patent Application Publication No. 2006-333983).

The massage machine proposed in Japanese Patent Application Publication No. 2001-314471, however, is not capable of treating forearms of a person to be treated.

Furthermore, in the massage machine proposed in Japanese Patent Application Publication No. 2006-333983, since the treatment unit needs to be wrapped around each of forearms of a person to be treated, it requires a lot of work to prepare, remove, and house the treatment unit, thus lacking convenience.

SUMMARY OF THE INVENTION

A first object of the present invention is to provide a chair-type massage machine that is capable of treating forearms of a person to be treated in a state where elbow joints of the person to be treated are extended.

A second object of the present invention is to provide a massage machine that is capable of treating forearms of a person to be treated when installed on an existing chair.

A chair-type massage machine disclosed herein includes a seat portion, a backrest portion that is reclinable rearward of the seat portion, and a forearm treatment portion that treats each of forearms of a person to be treated. In this configuration, the forearm treatment portion is mounted to each of both left and right side surfaces of the backrest portion.

A massage machine disclosed herein includes a back portion that is contacted by a back of a person to be treated and a forearm treatment portion that treats each of forearms of the person to be treated. In this configuration, the forearm treatment portion is mounted to each of both left and right ends of the back portion so as to be rotatable about a rotation axis extending along a left-right direction.

The significance and effects of the present invention will be made further apparent from the description of embodiments presented below. The following embodiments, however, are each strictly an embodiment of the present invention, and the present invention and the significance of the terms used to describe constituent components of the present invention are not limited to those described in the embodiments below.

DESCRIPTION OF THE PREFERRED EMBODIMENTS

With reference to the appended drawings, the following describes in detail illustrative embodiments of the present invention.

1. Chair-Type Massage Machine

Figure 1:
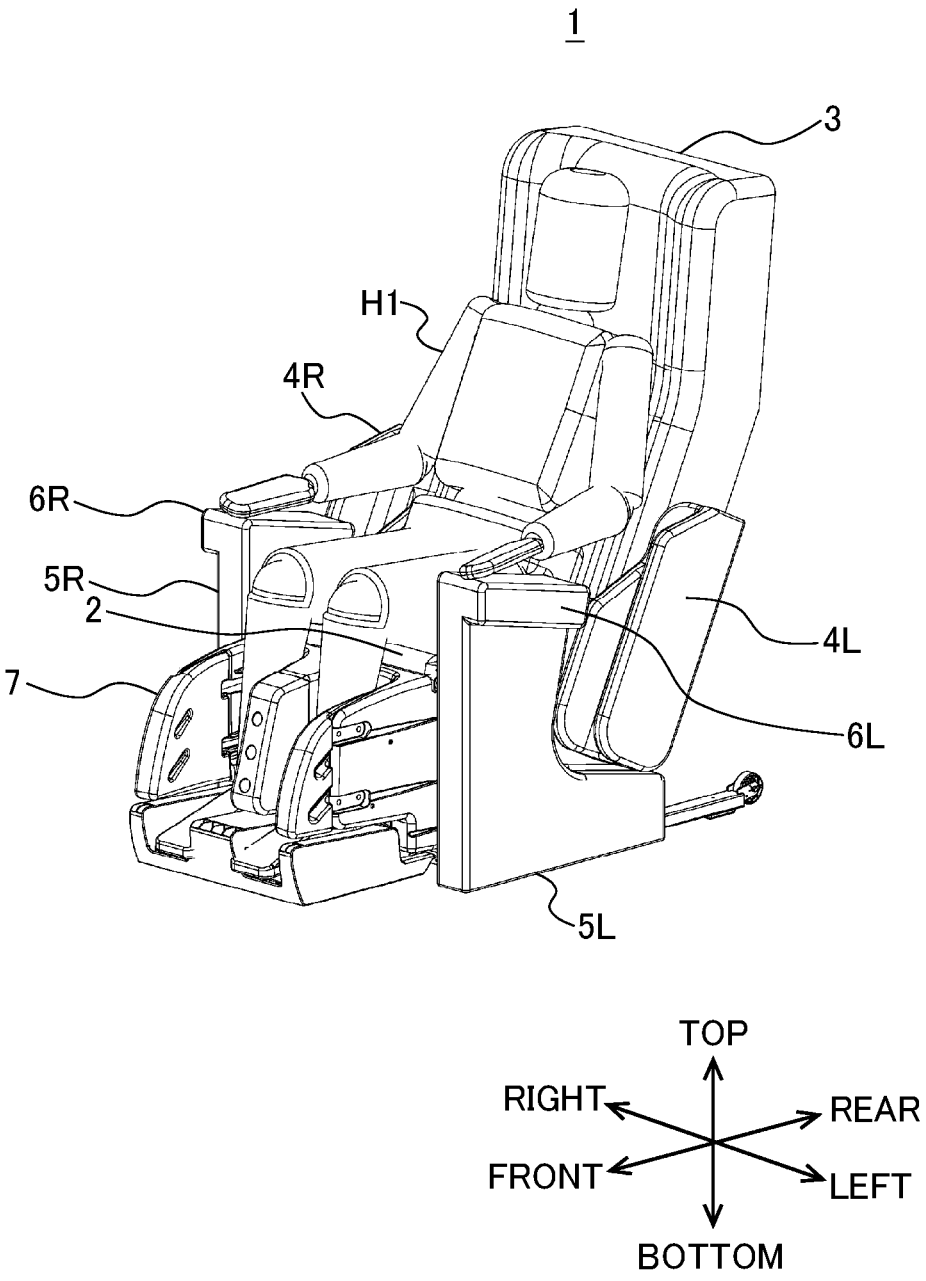
FIG. 1 is a perspective view of a chair-type massage machine according to an example embodiment.
Figure 2:
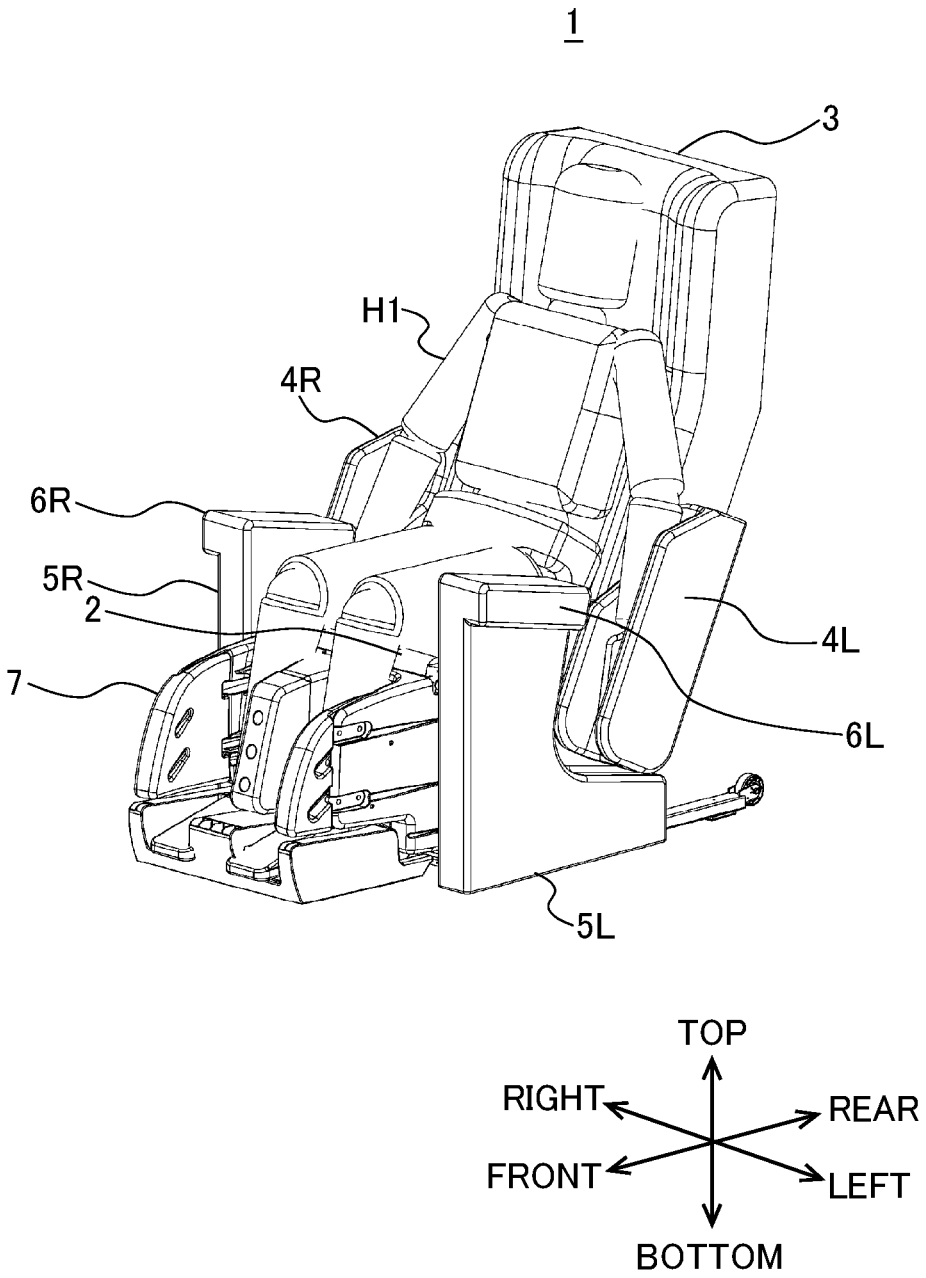
FIG. 2 is a perspective view of the chair-type massage machine according to the example embodiment.
Figure 3:
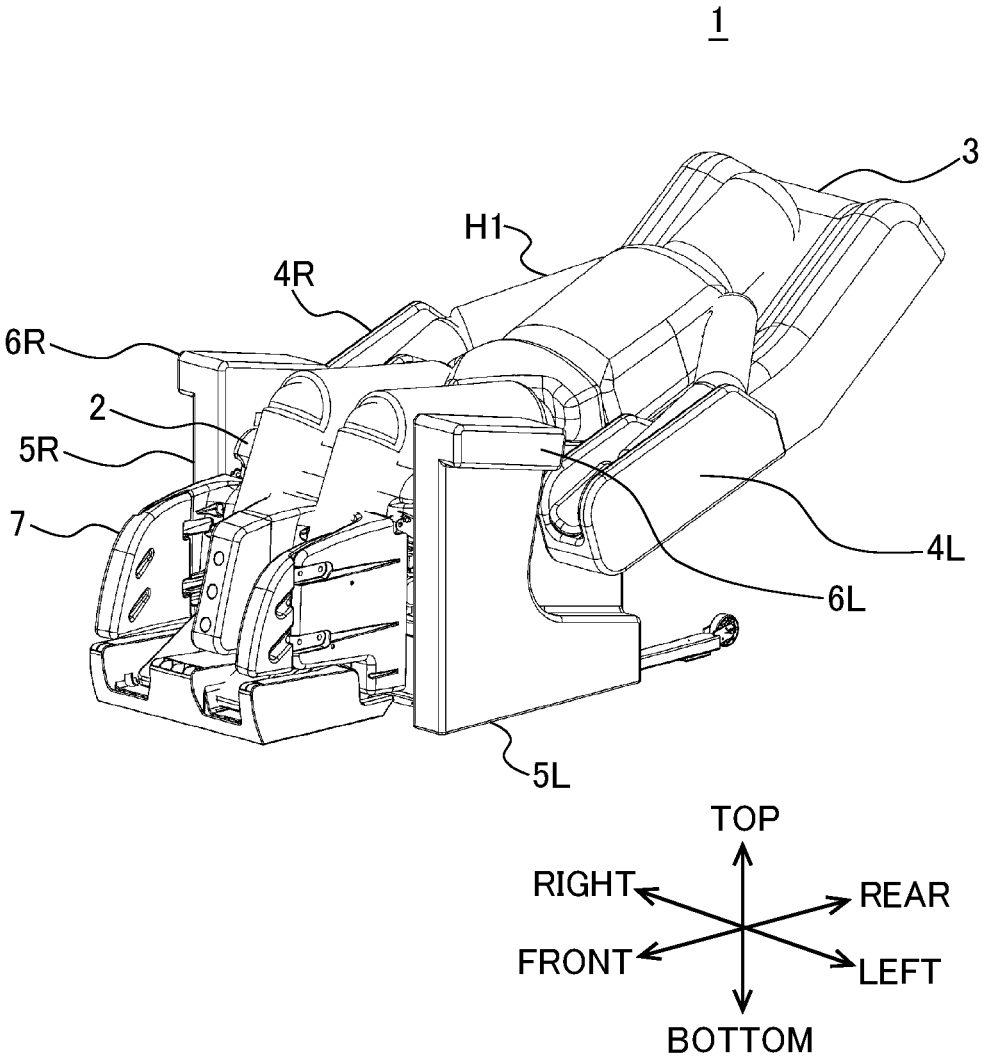
FIG. 3 is a perspective view of the chair-type massage machine according to the example embodiment.

FIG. 1 to FIG. 3 are perspective views of a chair-type massage machine 1 according to an example embodiment (hereinafter referred to as a "chair-type massage machine 1"). FIG. 1 shows a situation in which a backrest portion 3 is not reclined rearward of a seat portion 2 (an upright state) and a person to be treated H1 is using armrest portions 6L and 6R instead of forearm treatment portions 4L and 4R. FIG. 2 shows a situation in which the backrest portion 3 is in the upright state and the person to be treated H1 is using the forearm treatment portions 4L and 4R instead of the armrest portions 6L and 6R. FIG. 3 shows a situation in which the backrest portion 3 is reclined rearward of the seat portion 2 to the maximum extent (a fully reclined state) and the person to be treated H1 is using the forearm treatment portions 4L and 4R instead of the armrest portions 6L and 6R.

In the following description, a front side (a frontal side) as seen from the person to be treated H1 seated on the chair-type massage machine 1 in a state where the backrest portion 3 is not reclined is referred to as a "front side," and a rear side (a back side) as seen from the person to be treated H1 seated on the chair-type massage machine 1 in the state where the backrest portion 3 is not reclined is referred to as a "rear side." Furthermore, a top side (a head side) as seen from the person to be treated H1 seated on the chair-type massage machine 1 in the state where the backrest portion 3 is not reclined is referred to as a "top side," and a bottom side (a leg side) as seen from the person to be treated H1 seated on the chair-type massage machine 1 in the state where the backrest portion 3 is not reclined is referred to as a "bottom side." Furthermore, a right side as seen from the person to be treated H1 seated on the chair-type massage machine 1 in the state where the backrest portion 3 is not reclined is referred to as a "right side," and a left side as seen from the person to be treated H1 seated on the chair-type massage machine 1 in the state where the backrest portion 3 is not reclined is referred to as a "left side."

The chair-type massage machine 1 includes the seat portion 2, the backrest portion 3, a left and right pair of the forearm treatment portions 4L and 4R, a left and right pair of base portions 5L and 5R, a left and right pair of the armrest portions 6L and 6R, and an ottoman 7.

The seat portion 2 supports buttocks and thighs of the person to be treated H1.

The backrest portion 3 supports shoulders, hips, and a back of the person to be treated H1. The backrest portion 3 is rotatable about a reclining rotation axis extending along a left-right direction. That is, the backrest portion 3 is reclinable rearward of the seat portion 2. The backrest portion 3 is provided with a massage unit (not shown) having a treatment member. The massage unit moves up and down in a longitudinal direction of the backrest portion 3 by being guided by guide rails (not shown) provided on the backrest portion 3. The guide rails may be provided to extend further to a rear part of the seat portion 2 so as to allow the massage unit to move up and down along a longitudinal direction of the seat portion 2 and the longitudinal direction of the backrest portion 3. The massage unit includes the treatment member, a kneading drive mechanism that drives the treatment member to perform a kneading operation, and a tapping drive mechanism that drives the treatment member to perform a tapping operation.

The forearm treatment portion 4L is mounted to a left side surface of the backrest portion 3, and the forearm treatment portion 4R is mounted to a right side surface of the backrest portion 3. With this configuration, regardless of whether or not the backrest portion 3 is relined rearward of the seat portion 2, the person to be treated H1 can have his/her forearms treated by the forearm treatment portions 4L and 4R in a state where his/her elbow joints are extended. It is only required that respective longitudinal directions of the forearm treatment portions 4L and 4R and the longitudinal direction of the backrest portion 3 be so closely aligned with each other that the forearms of the person to be treated H1 can be treated by the forearm treatment portions 4L and 4R in the state where the elbow joints of the person to be treated H1 are extended. For example, an intersecting angle (an acute intersecting angle) between the respective longitudinal directions of the forearm treatment portions 4L and 4R and the longitudinal direction of the backrest portion 3 is set to an angle of preferably 30° or less and more preferably 10° or less.

Furthermore, as described above, the forearm treatment portions 4L and 4R are mounted to the left and right side surfaces of the backrest portion 3, respectively, and thus when the backrest portion 3 is reclined rearward of the seat portion 2, it is possible to fix a relative position between the backrest portion 3 and each of the forearm treatment portions 4L and 4R. Accordingly, in a case where the backrest portion 3 is reclined rearward of the seat portion 2, treatment positions (at which massage is applied) on the forearms of the person to be treated H1 can be prevented from being displaced from intended positions toward wrists of the person to be treated H1.

A concave part of the forearm treatment portion 4L houses the left forearm and a left hand of the person to be treated H1. The forearm treatment portion 4L is not necessarily required to house the left forearm and the left hand of the person to be treated H1 in their entirety and is only required to house at least part of the left forearm of the person to be treated H1. An air bag (not shown) is provided in the concave part of the forearm treatment portion 4L. The air bag provided in the concave part of the forearm treatment portion 4L expands and contracts to massage the left forearm and the left hand of the person to be treated H1. The forearm treatment portion 4L is not necessarily required to be capable of massaging the left forearm and the left hand of the person to be treated H1 in their entirety and is only required to be capable of massaging at least part of the left forearm of the person to be treated H1.

A concave part of the forearm treatment portion 4R houses the right forearm and a right hand of the person to be treated H1. The forearm treatment portion 4R is not necessarily required to house the right forearm and the right hand of the person to be treated H1 in their entirety and is only required to house at least part of the right forearm of the person to be treated H1. An air bag (not shown) is provided in the concave part of the forearm treatment portion 4R. The air bag provided in the concave part of the forearm treatment portion 4R expands and contracts to massage the right forearm and the right hand of the person to be treated H1. The forearm treatment portion 4R is not necessarily required to be capable of massaging the right forearm and the right hand of the person to be treated H1 in their entirety and is only required to be capable of massaging at least part of the right forearm of the person to be treated H1.

Treatment for the forearms and the hands of the person to be treated H1 performed by the forearm treatment portions 4L and 4R is not limited to massaging and is only required to be treatment performed using a physical tool. Accordingly, treatment for the forearms and the hands of the person to be treated H1 performed by the forearm treatment portions 4L and 4R may be, for example, treatment of heating the forearms and the hands or treatment of applying electrical stimulation to an area to be treated. The forearm treatment portions 4L and 4R may have a configuration including, for example, a treatment member, the air bag, a vibrator, a heater, or an electrode pad alone or in combination of a plurality thereof.

Each of the concave parts of the forearm treatment portions 4L and 4R is concave in a direction directed from an abdomen of the person to be treated H1 toward his/her back in a state where the person to be treated H1 is seated leaning against the backrest portion 3.

The base portion 5L is provided to stand on a left side of the seat portion 2 and supports the armrest portion 6L. The base portion 5R is provided to stand on a right side of the seat portion 2 and supports the armrest portion 6R. Accordingly, the armrest portion 6L is disposed on an upper left side of the seat portion 2, and the armrest portion 6R is disposed on an upper right side of the seat portion 2. The armrest portions 6L and 6R are unaffected by positions and shapes of the forearm treatment portions 4L and 4R, and thus the armrest portions 6L and 6R can be designed to be suitable as armrests in terms of positions and shapes thereof.

The ottoman 7 houses lower legs and feet of the person to be treated H1. The ottoman 7 is mounted to an upper front end of a frame member supporting the seat portion 2 so as to be rotatable about a rotation axis extending along the left-right direction.

The ottoman 7 is provided with air bags. The air bags provided in the ottoman 7 expand and contract to massage the lower legs and the feet of the person to be treated H1.

Unlike in this example embodiment, the ottoman 7 may be provided with any other treatment tool than the air bags or may not be provided with any treatment tool.

Next, a further description is given of the backrest portion 3 and the forearm treatment portions 4L and 4R.

The chair-type massage machine 1 includes a left-side first adjustment portion (not shown) that is capable of adjusting a position of the forearm treatment portion 4L in the longitudinal direction with respect to the backrest portion 3 and a right-side first adjustment portion (not shown) that is capable of adjusting a position of the forearm treatment portion 4R in the longitudinal direction with respect to the backrest portion 3. The left-side first adjustment portion and the right-side first adjustment portion are provided, and thus the treatment positions (at which massage is applied) on the forearms of the person to be treated H1 can be adjusted depending on a height of the person to be treated H1.

For example, a known slide mechanism can be used as each of the left-side first adjustment portion and the right-side first adjustment portion. A change in the relative position between the backrest portion 3 and the forearm treatment portion 4L resulting from adjustment by the left-side first adjustment portion is not limited only to a change in the relative position in the longitudinal direction of the forearm treatment portion 4L and could be a change in the relative position in a direction including a component of the longitudinal direction of the forearm treatment portion 4L. Similarly, a change in the relative position between the backrest portion 3 and the forearm treatment portion 4R resulting from adjustment by the right-side first adjustment portion is not limited only to a change in the relative position in the longitudinal direction of the forearm treatment portion 4R and could be a change in the relative position in a direction including a component of the longitudinal direction of the forearm treatment portion 4R.

The chair-type massage machine 1 includes a left-side second adjustment portion (not shown) that is capable of adjusting a position of the forearm treatment portion 4L in the left-right direction with respect to the backrest portion 3 and a right-side second adjustment portion (not shown) that is capable of adjusting a position of the forearm treatment portion 4R in the left-right direction with respect to the backrest portion 3. The left-side second adjustment portion and the right-side second adjustment portion are provided, and thus the treatment positions (at which massage is applied) on the forearms of the person to be treated H1 can be adjusted depending on a breadth of the person to be treated H1.

For example, a known slide mechanism can be used as each of the left-side second adjustment portion and the right-side second adjustment portion. A change in the relative position between the backrest portion 3 and the forearm treatment portion 4L resulting from adjustment by the left-side second adjustment portion is not limited only to a change in the relative position in a left-right direction of the forearm treatment portion 4L and could be a change in the relative position in a direction including a component of the left-right direction of the forearm treatment portion 4L. Similarly, a change in the relative position between the backrest portion 3 and the forearm treatment portion 4R resulting from adjustment by the right-side second adjustment portion is not limited only to a change in the relative position in a left-right direction of the forearm treatment portion 4R and could be a change in the relative position in a direction including a component of the left-right direction of the forearm treatment portion 4R.

The chair-type massage machine 1 includes a left-side third adjustment portion (not shown) that is capable of adjusting a position of the forearm treatment portion 4L in a predetermined direction with respect to the backrest portion 3 and a right-side third adjustment portion (not shown) that is capable of adjusting a position of the forearm treatment portion 4R in the predetermined direction with respect to the backrest portion 3. Here, the above-described predetermined direction is a direction perpendicular to the left-right direction and the respective longitudinal directions of the forearm treatment portions 4L and 4R. In this example embodiment, the above-described predetermined direction is substantially parallel to the concave direction of each of the concave parts of the forearm treatment portions 4L and 4R. The left-side third adjustment portion and the right-side third adjustment portion are provided, and thus the degree of straightening a posture of the person to be treated H1 can be adjusted depending on preference of the person to be treated H1. Instead of providing the left-side third adjustment portion and the right-side third adjustment portion or in addition thereto, air bags may be provided in the concave parts of the forearm treatment portions 4L and 4R, respectively, so as to come in contact with back sides of the forearms of the person to be treated H1. The degree of expansion of the air bags is adjusted, and thus there can be obtained a similar effect to the effect of the left-side third adjustment portion and the right-side third adjustment portion.

For example, a known slide mechanism can be used as each of the left-side third adjustment portion and the right-side third adjustment portion. A change in the relative position between the backrest portion 3 and the forearm treatment portion 4L resulting from adjustment by the left-side third adjustment portion is not limited only to a change in the relative position in the above-described predetermined direction and could be a change in the relative position in a direction including a component of the above-described predetermined direction. Similarly, a change in the relative position between the backrest portion 3 and the forearm treatment portion 4R resulting from adjustment by the right-side third adjustment portion is not limited only to a change in the relative position in the above-described predetermined direction and could be a change in the relative position in a direction including a component of the above-described predetermined direction.

Figure 4:
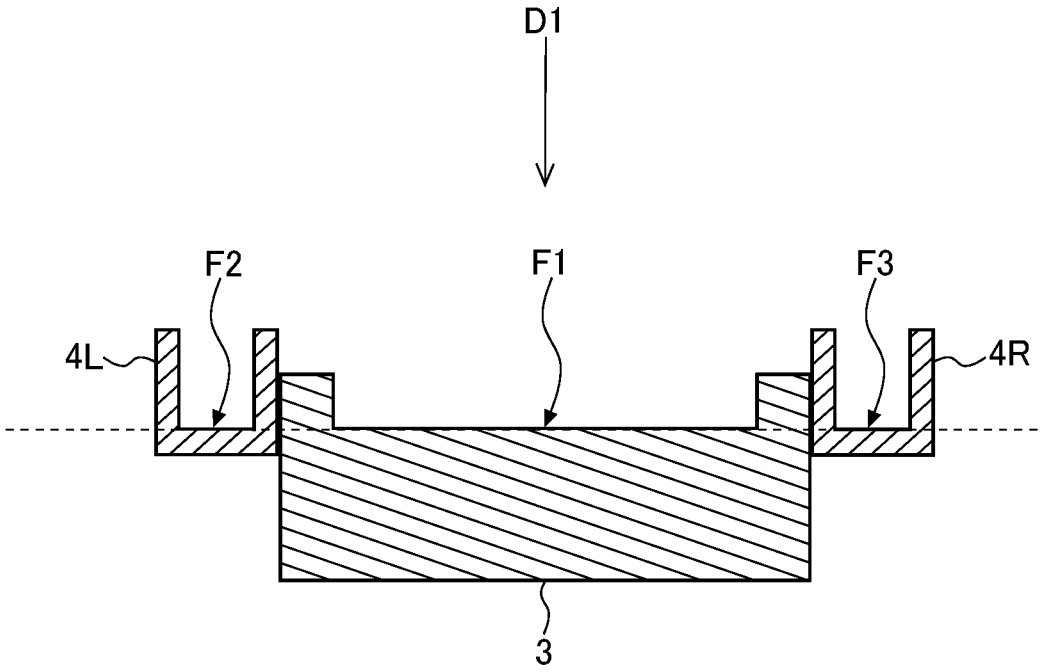
FIG. 4 is a schematic sectional view of a backrest portion and forearm treatment portions of the chair-type massage machine according to the example embodiment.

FIG. 4 is a schematic view showing sections of the backrest portion 3 and the forearm treatment portions 4L and 4R cut along a plane perpendicular to the respective longitudinal directions of the forearm treatment portions 4L and 4R. In this example embodiment, as shown in FIG. 4, in a direction D1 directed from the abdomen of the person to be treated H1 toward his/her back in the state where the person to be treated H1 is seated leaning against the backrest portion 3, a surface F1 of the backrest portion 3 contacted by the back of the person to be treated H1 and a surface F2 of the forearm treatment portion 4L and a surface F3 of the forearm treatment portion 4R contacted respectively by the back sides of the forearms of the person to be treated H1 are aligned with each other. This configuration can prevent the person to be treated H1 from suffering from rounded shoulders while being treated, thus being effective in, for example, relieving stiff shoulders.

Figure 5:
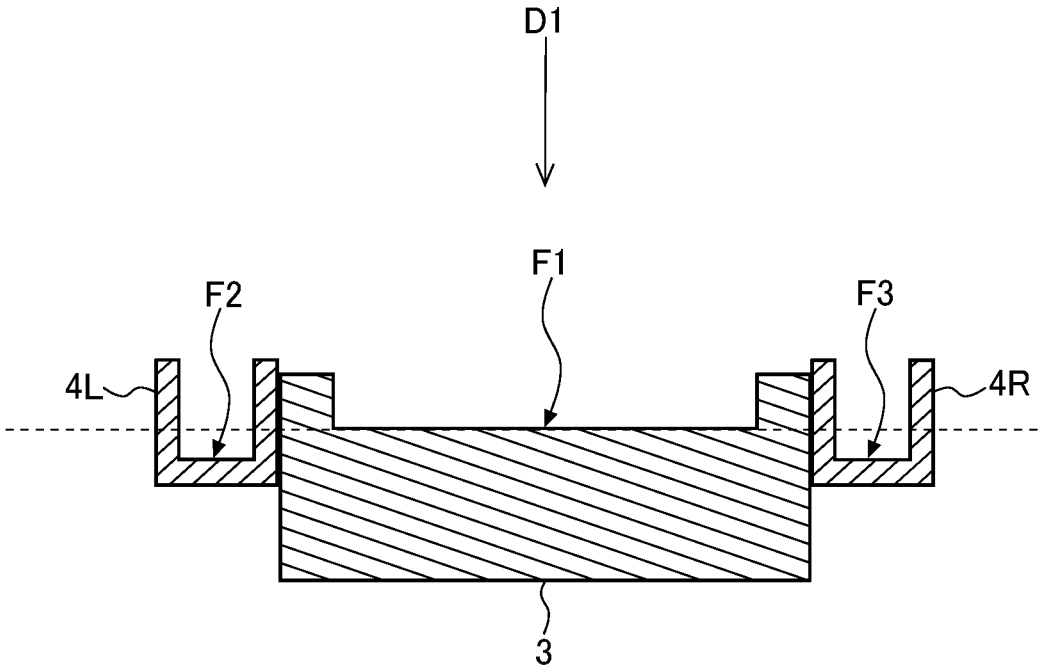
FIG. 5 is a schematic sectional view of a backrest portion and forearm treatment portions of a chair-type massage machine according to a modification example.

Unlike in this example embodiment, as shown in FIG. 5, in the direction D1 directed from the abdomen of the person to be treated H1 toward his/her back in the state where the person to be treated H1 is seated leaning against the backrest portion 3, the surface F1 of the backrest portion 3 contacted by the back of the person to be treated H1 and the surface F2 of the forearm treatment portion 4L and the surface F3 of the forearm treatment portion 4R contacted respectively by the back sides of the forearms of the person to be treated H1 may be arranged in this order. In the direction D1, the surface F2 and the surface F3 are aligned with each other. This configuration allows the person to be treated H1 to pull his/her shoulders back while being treated, thus being effective in, for example, relieving stiff shoulders and allowing his/her pectoralis major muscle to be stretched.

The foregoing embodiment is to be construed in all respects as illustrative and not limiting. It is to be understood that the technical scope of the present invention is indicated by the appended claims rather than by the description of the foregoing embodiment, and that all changes that come within the meaning and range of equivalency of the claims are embraced therein.

In the above-described example embodiment, a width of the backrest portion 3 in the left-right direction is substantially constant at any position on the backrest portion 3 in the longitudinal direction thereof. However, for example, a configuration may be adopted in which, as shown in FIG. 6, a width W1 of a first part P1 of the backrest portion 3 in the left-right direction is smaller than a width W2 of a second part P2 of the backrest portion 3 in the left-right direction, the forearm treatment portions 4L and 4R being mounted to both left and right side surfaces of the first part P1, respectively, the second part P2 being located upward of the first part P1.

Figure 6:
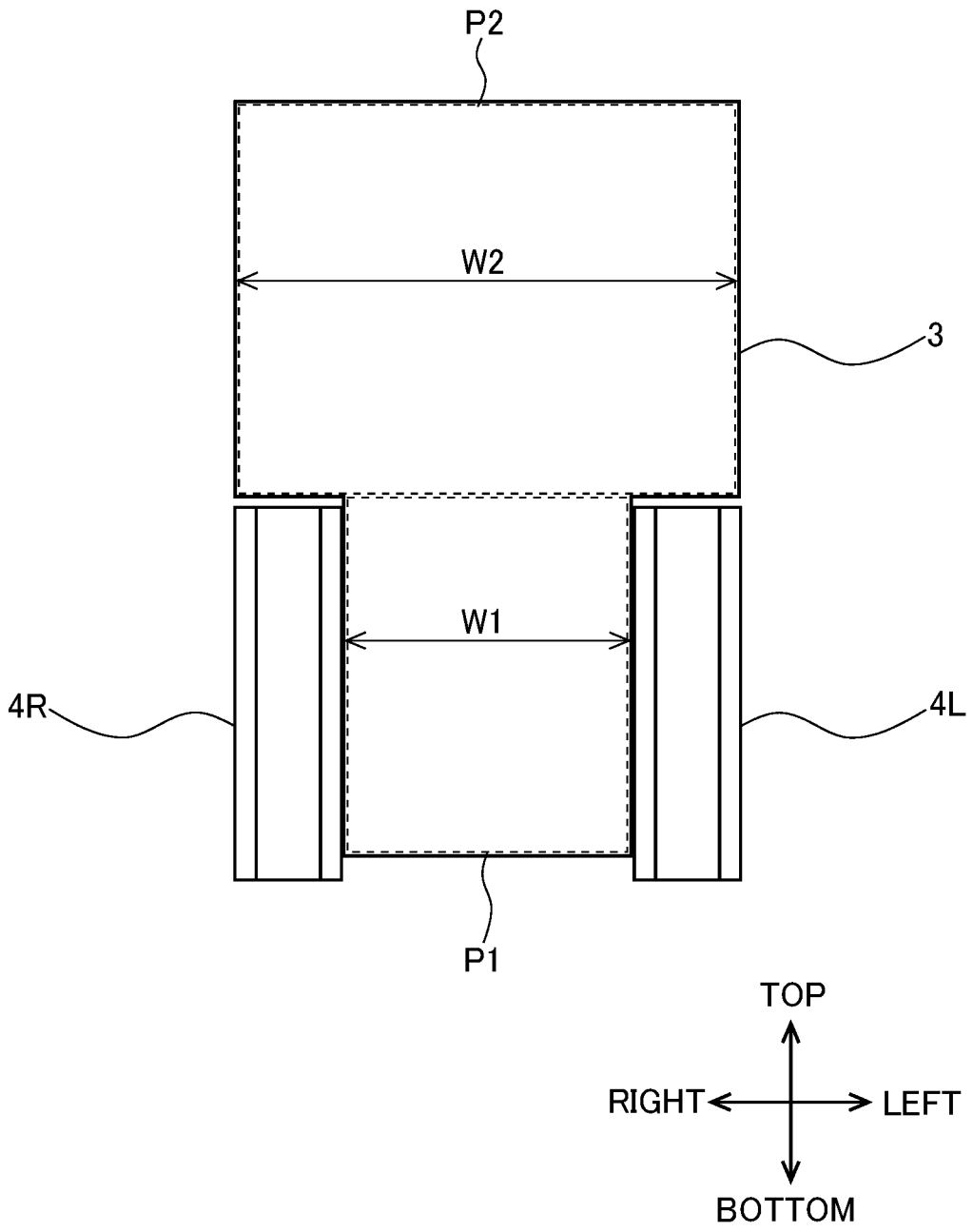
FIG. 6 is a schematic frontal view of a backrest portion and forearm treatment portions of a chair-type massage machine according to another modification example.

According to the configuration shown in FIG. 6, for example, without the need to adopt a configuration in which a distance in the left-right direction between an installation position of an air bag for massaging a left front shoulder joint area of the person to be treated H1 and an installation position of an air bag for massaging a right front shoulder joint area of the person to be treated H1 is narrower than a distance in the left-right direction between an installation position of an air bag for massaging an outer side of the left forearm of the person to be treated H1 and an installation position of an air bag for massaging an outer side of the right forearm of the person to be treated H1, the air bags for massaging the front shoulder joint areas of the person to be treated H1 can be installed in the second part P2 of the backrest portion 3. With this configuration, the front shoulder joint areas and the outer sides of the forearms of the person to be treated H1 can be treated without requiring the person to be treated H1 to spread his/her arms apart.

Furthermore, for example, a configuration may be adopted in which, unlike in the above-described example embodiment, the concave part of the forearm treatment portion 4L is concave rightward, and the concave part of the forearm treatment portion 4R is concave leftward. In this case, the person to be treated H1 can pull out his/her arms from the forearm treatment portions 4L and 4R by spreading the arms sideways, and thus an action of pulling out the arms from the forearm treatment portions 4L and 4R is facilitated.

2. Massage Machine

Figure 7:
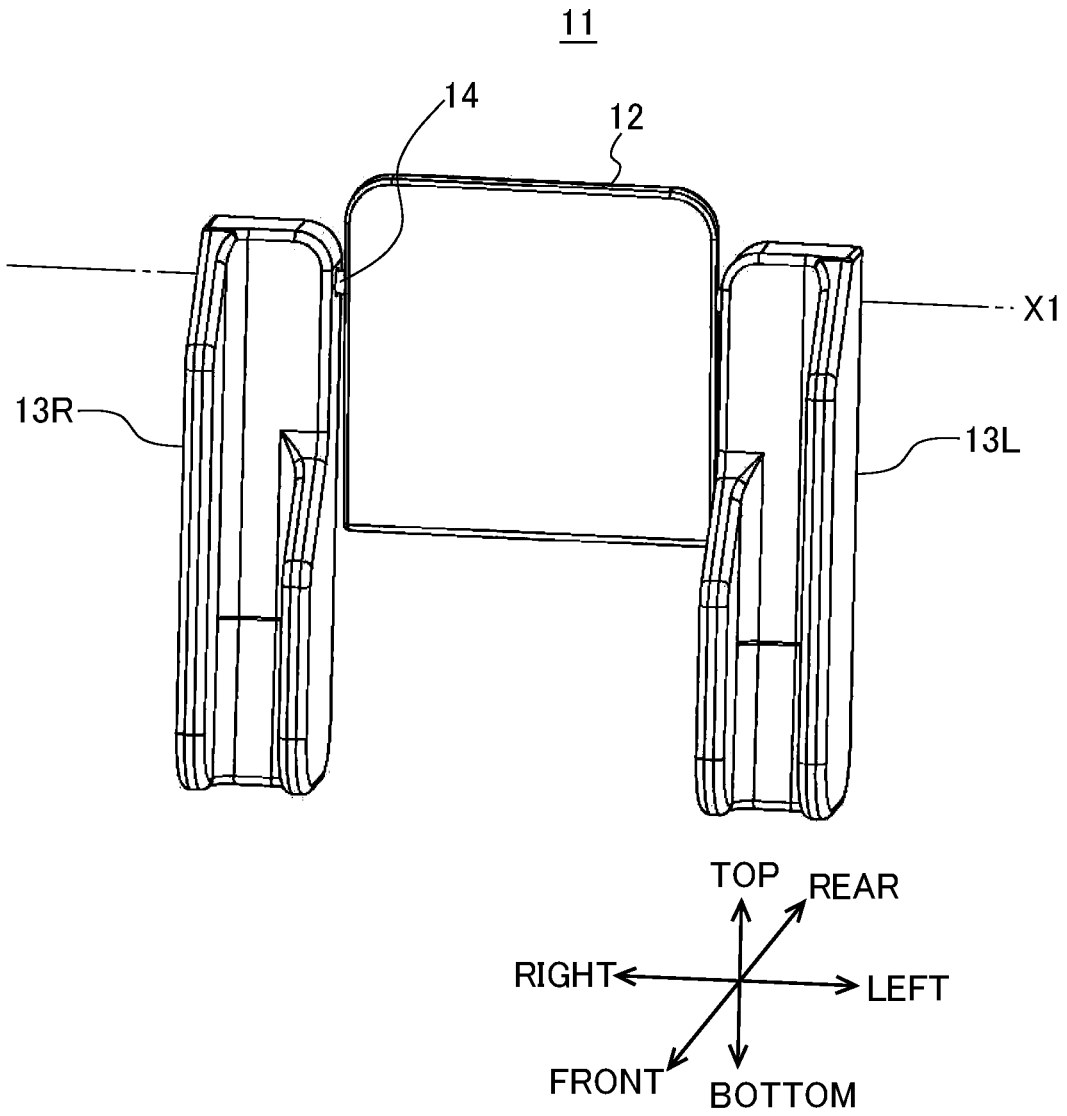
FIG. 7 is a perspective view of a massage machine according to an example embodiment.

FIG. 7 is a perspective view of a massage machine 11 according to one example embodiment (hereinafter referred to as a "massage machine 11"). The massage machine 11 is installed on a chair and used in that state (see after-mentioned FIG. 8 to FIG. 12).

In the following description, a front side (a frontal side) and a rear side (a back side) as seen from a person to be treated whose back is in contact with a back portion 12 are referred to as a "front side" and a "rear side," respectively. Furthermore, a top side (a head side) and a bottom side (a leg side) of the person to be treated whose back is in contact with the back portion 12 are referred to as a "top side" and a "bottom side," respectively. Furthermore, a right side and a left side as seen from the person to be treated whose back is in contact with the back portion 12 are referred to as a "right side" and a "left side," respectively.

The massage machine 11 includes the back portion 12 and a left and right pair of forearm treatment portions 13L and 13R.

When the person to be treated uses the massage machine 11, the back portion 12 is contacted by the back of the person to be treated.

The forearm treatment portion 13L is mounted to an upper left end of the back portion 12 so as to be rotatable about a rotation axis X1 extending along a left-right direction. The forearm treatment portion 13R is mounted to a right side surface of the back portion 12 so as to be rotatable about the rotation axis X1 extending along the left-right direction.

Figure 8:
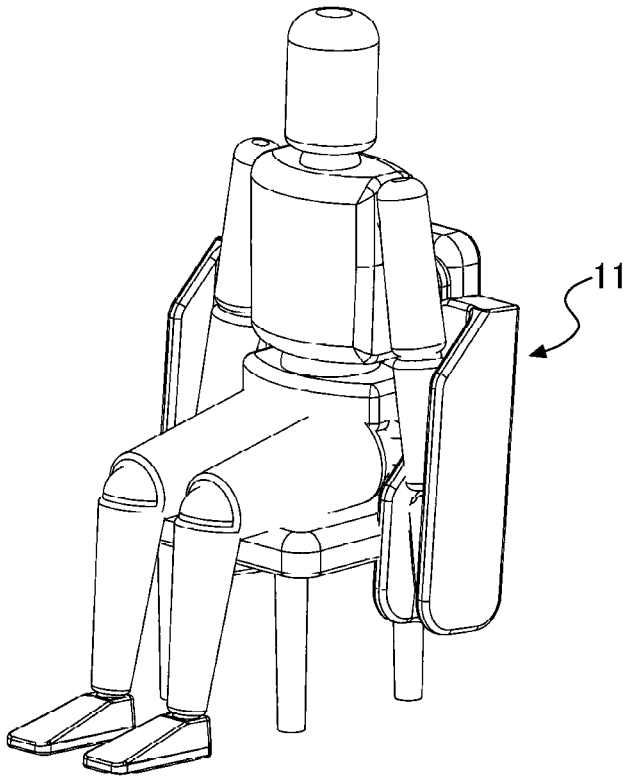
FIG. 8 is a view showing an example of how the massage machine according to the example embodiment is used.
Figure 9:
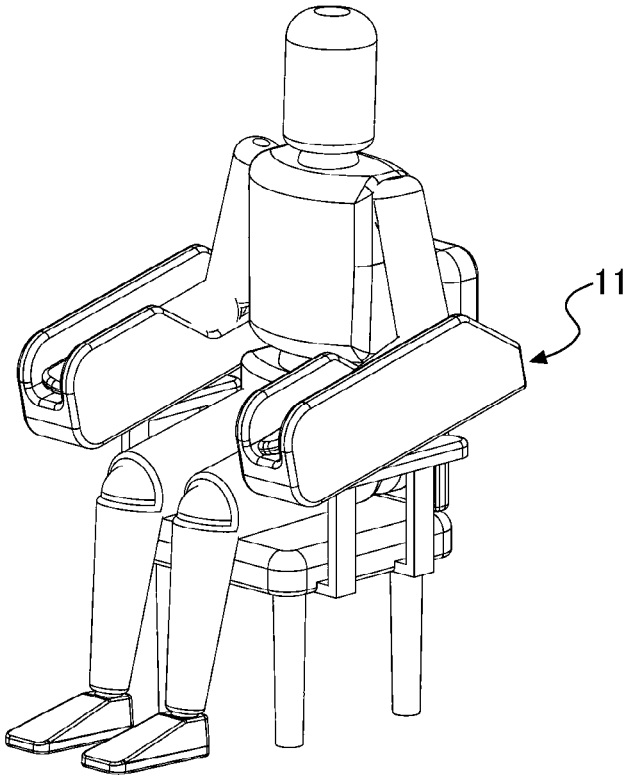
FIG. 9 is a view showing another example of how the massage machine according to the example embodiment is used.
Figure 10:
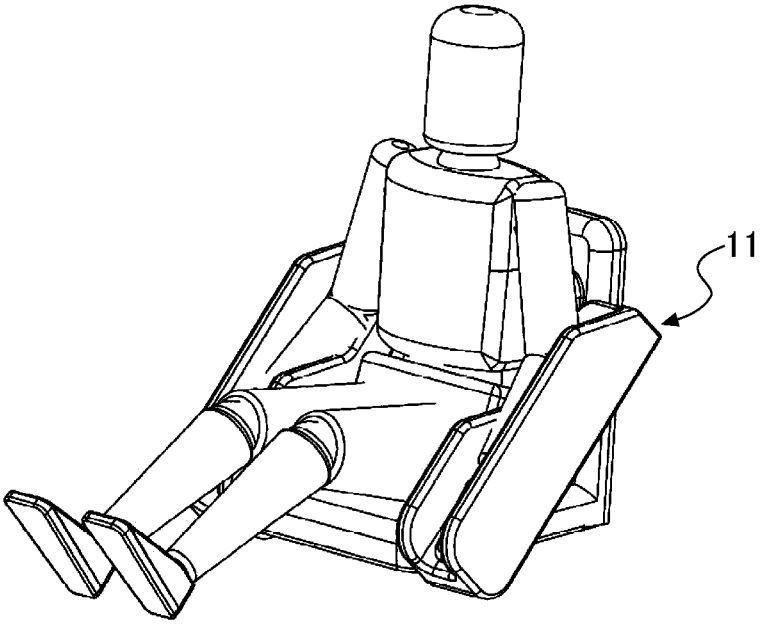
FIG. 10 is a view showing yet another example of how the massage machine according to the example embodiment is used.
Figure 11:
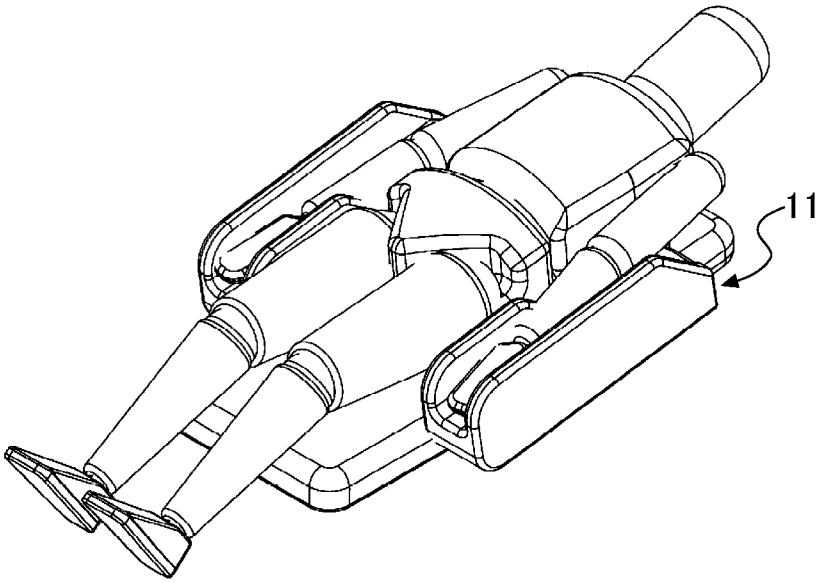
FIG. 11 is a view showing still another example of how the massage machine according to the example embodiment is used.
Figure 12:
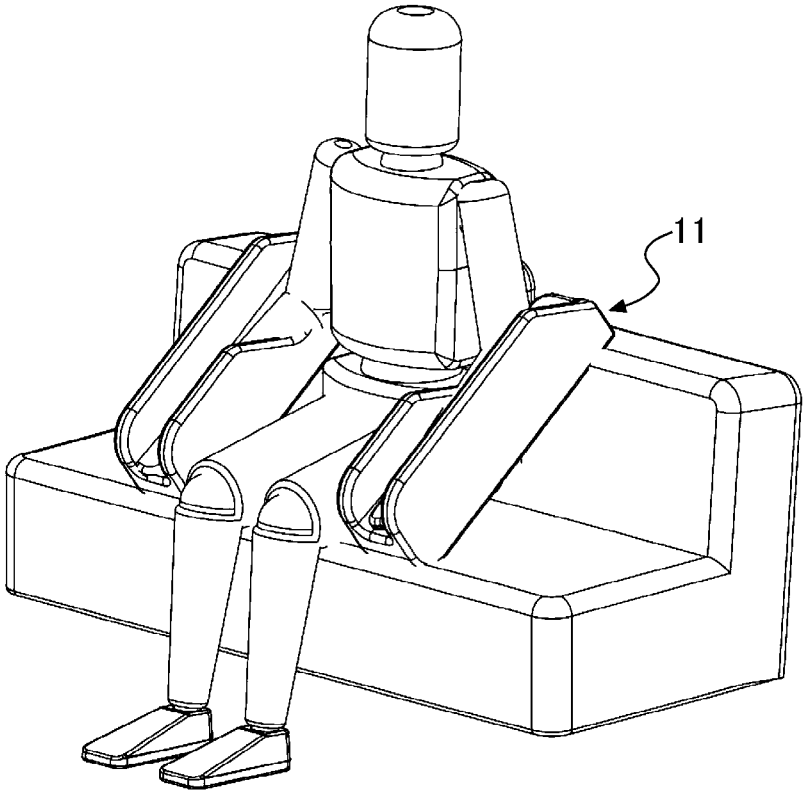
FIG. 12 is a view showing still another example of how the massage machine according to the example embodiment is used.

The forearm treatment portions 13L and 13R are mounted so as to be rotatable with respect to the back portion 12, and thus the massage machine 11 can be installed on any of various existing types of chairs. For example, the massage machine 11 can be installed and used on a chair with no armrest portions as shown in FIG. 8. Furthermore, the massage machine 11 can be installed and used on a chair with armrest portions as shown in FIG. 9. Furthermore, the massage machine 11 can be installed and used on a legless chair as shown in FIG. 10. Furthermore, the massage machine 11 can be installed and used on a legless chair having a reclining mechanism in a state where a backrest portion thereof is reclined as shown in FIG. 11. Furthermore, the massage machine 11 can be installed and used on a sofa as shown in FIG. 12.

Figure 13:
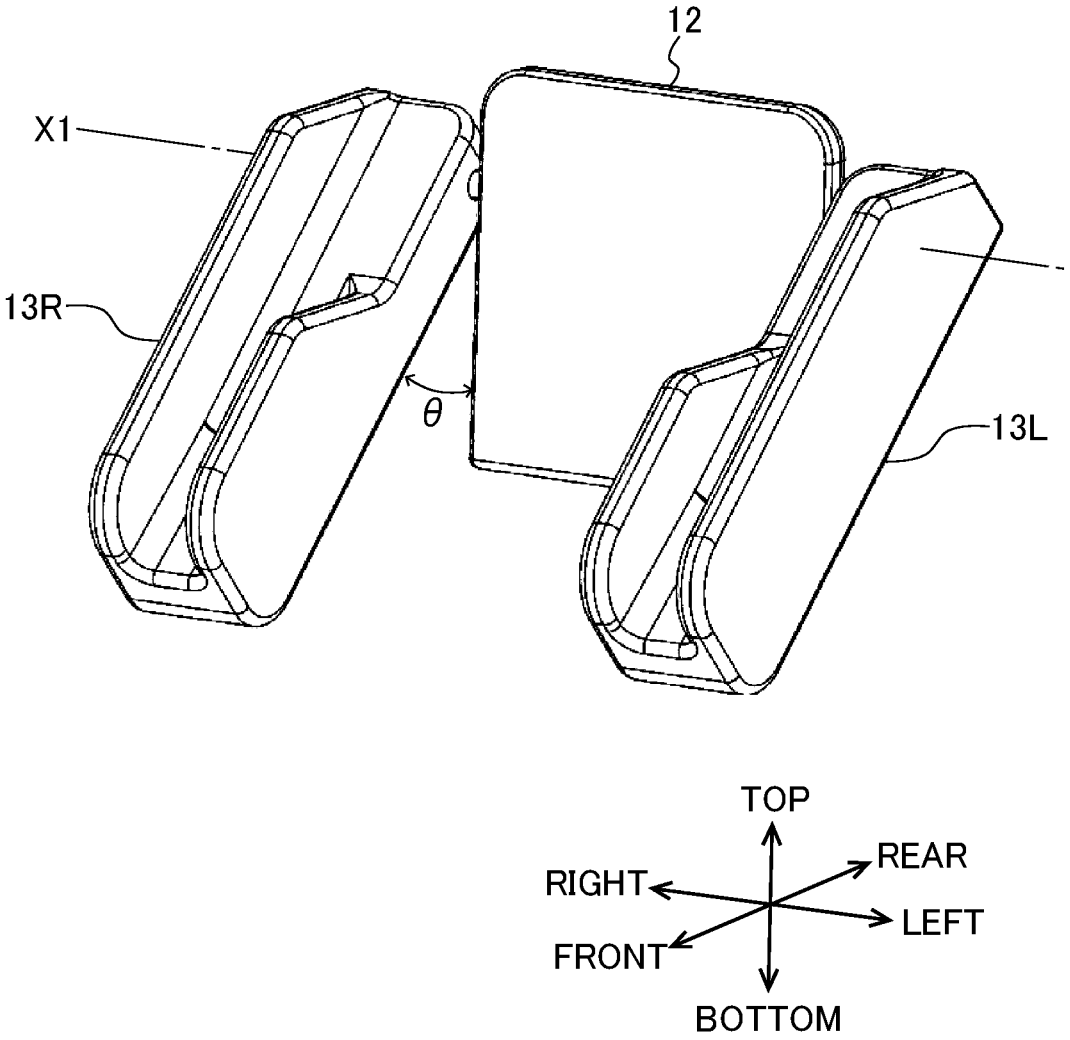
FIG. 13 is a perspective view of the massage machine according to the example embodiment.

The forearm treatment portions 13L and 13R may be rotatable at an angle of, for example, 360° without any limitation or in an angle range of, for example, 0° to 90°. Here, an angle of 0° corresponds to a state shown in FIG. 8, namely, a state where the forearm treatment portions 13L and 13R are oriented with hand-housing sides thereof disposed on a bottom side and respective longitudinal directions of the forearm treatment portions 13L and 13R extend along a top-bottom direction. Furthermore, an angle of 90° corresponds to a state where 8 shown in FIG. 13 has an angle value of 90°, namely, a state where the forearm treatment portions 13L and 13R are oriented with the hand-housing sides thereof disposed on a front side and the respective longitudinal directions of the forearm treatment portions 13L and 13R extend along a front-rear direction.

A concave part of the forearm treatment portion 13L is concave toward a back side of a forearm of the person to be treated and houses the left forearm and a left hand of the person to be treated. The forearm treatment portion 13L is not necessarily required to house the left forearm and the left hand of the person to be treated in their entirety and is only required to house at least part of the left forearm of the person to be treated. An air bag (not shown) is provided in the concave part of the forearm treatment portion 13L. The air bag provided in the concave part of the forearm treatment portion 13L expands and contracts to massage the left forearm and the left hand of the person to be treated. The forearm treatment portion 13L is not necessarily required to be capable of massaging the left forearm and the left hand of the person to be treated in their entirety and is only required to be capable of massaging at least part of the left forearm of the person to be treated.

A concave part of the forearm treatment portion 13R is concave toward a back side of a forearm of the person to be treated and houses the right forearm and a right hand of the person to be treated. The forearm treatment portion 13R is not necessarily required to house the right forearm and the right hand of the person to be treated in their entirety and is only required to house at least part of the right forearm of the person to be treated. An air bag (not shown) is provided in the concave part of the forearm treatment portion 13R. The air bag provided in the concave part of the forearm treatment portion 13R expands and contracts to massage the right forearm and the right hand of the person to be treated. The forearm treatment portion 13R is not necessarily required to be capable of massaging the right forearm and the right hand of the person to be treated in their entirety and is only required to be capable of massaging at least part of the right forearm of the person to be treated.

Treatment for the forearms and the hands of the person to be treated performed by the forearm treatment portions 13L and 13R is not limited to massaging and is only required to be treatment performed using a physical tool. Accordingly, treatment for the forearms and the hands of the person to be treated performed by the forearm treatment portions 13L and 13R may by, for example, treatment of heating the forearms and the hands or treatment of applying electrical stimulation to an area to be treated. The forearm treatment portions 13L and 13R may have a configuration including, for example, a treatment member, the air bag, a vibrator, a heater, or an electrode pad alone or in combination of a plurality thereof.

The massage machine 11 includes a left-side adjustment portion (not shown) that is capable of adjusting a position of the forearm treatment portion 13L in the left-right direction with respect to the back portion 12 and a right-side adjustment portion (not shown) that is capable of adjusting a position of the forearm treatment portion 13R in the left-right direction with respect to the back portion 12. The left-side adjustment portion and the right-side adjustment portion are provided, and thus treatment positions (at which massage is applied) on the forearms of the person to be treated can be adjusted depending on a breadth of the person to be treated.

For example, a shaft 14 is provided to penetrate the back portion 12 in the left-right direction so as to couple the back portion 12 to the forearm treatment portion 13L on a left side and to the forearm treatment portion 13R on a right side. The shaft 14 is structured to be extendable on the left side in a longitudinal direction (the left-right direction), and thus the shaft 14 can be used as the left-side adjustment portion. Similarly, for example, the shaft 14 is structured to be extendable on the right side in the longitudinal direction (the left-right direction), and thus the shaft 14 can be used as the right-side adjustment portion. Unlike in this example embodiment, for example, there may be used two shafts instead of the single shaft 14, specifically, a left-side shaft that is extendable in a longitudinal direction (the left-right direction) and couples the back portion 12 to the forearm treatment portion 13L and a right-side shaft that is extendable in a longitudinal direction (the left-right direction) and couples the back portion 12 to the forearm treatment portion 13R.

Figure 14:
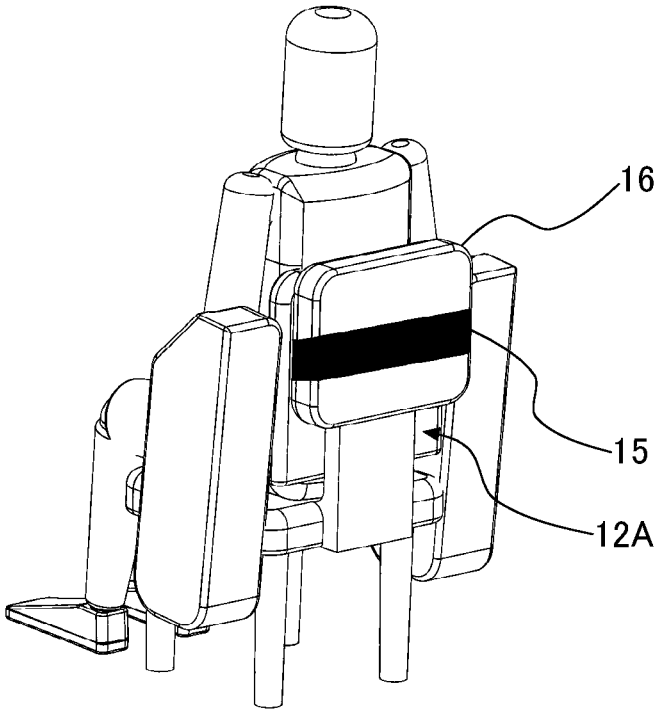
FIG. 14 is a perspective rear view of the massage machine according to the example embodiment.

The massage machine 11 includes a belt 15 that extends along the left-right direction. The belt 15 is provided on a back surface 12A of the back portion 12. The belt 15 is secured at both ends thereof to the back portion 12. With this configuration, as shown in FIG. 14, a backrest portion 16 of a chair can be held between the back surface 12A of the back portion 12 and the belt 15, and thus the massage machine 11 can be prevented from falling when the person to be treated is not seated on the chair. The belt 15 preferably has such an elastic property as to be stretchable in the left-right direction so that it can hold the backrest portion 16 having any of various shapes.

The foregoing embodiment is to be construed in all respects as illustrative and not limiting. It is to be understood that the technical scope of the present invention is indicated by the appended claims rather than by the description of the foregoing embodiment, and that all changes that come within the meaning and range of equivalency of the claims are embraced therein.

The massage machine 11 includes the air bags provided in the concave parts of the forearm treatment portions 13L and 13R and therefore also includes an air pump that supplies air to the air bags. Although there is no particular limitation on where the air pump is disposed, in the massage machine 11, the air pump is disposed at any of the back portion 12, the forearm treatment portion 13L, and the forearm treatment portion 13R. In order to achieve a good weight balance on the left and right sides, the air pump is preferably provided at a center of the back portion 12 in the left-right direction.

Figure 15:
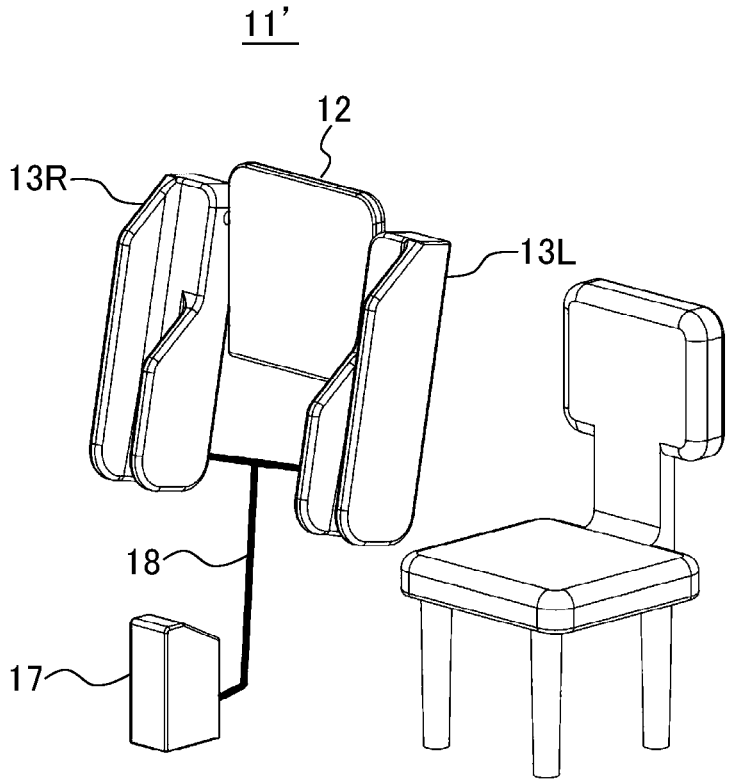
FIG. 15 is a perspective view of a massage machine according to a modification example.

Unlike the above-described massage machine 11, as in a massage machine 11' shown in FIG. 15, an air pump housing portion 17 housing an air pump may be provided as a separate body from the back portion 12 and the forearm treatment portions 13L and 13R. In this case, the air pump housing portion 17 and the forearm treatment portions 13L and 13R are connected via an air hose 18 having flexibility, and air is suppled from the air pump in the air pump housing portion 17 to the air bags provided respectively in the forearm treatment portions 13L and 13R via the air hose 18.

In the massage machine 11' shown in FIG. 15, the air pump housing portion 17 is provided as a separate body from the back portion 12 and the forearm treatment portions 13L and 13R, and thus it is possible to achieve a weight reduction of portions installed on a chair (the back portion 12 and the forearm treatment portions 13L and 13R). This configuration facilitates installation of the back portion 12 and the forearm treatment portions 13L and 13R on the chair. This configuration also facilitates removal of the back portion 12 and the forearm treatment portions 13L and 13R from the chair.

Furthermore, for example, a treatment portion that treats at least part of the back and hips of the person to be treated may be provided at the back portion 12. Treatment for at least part of the back and the hips of the person to be treated performed by the treatment portion provided at the back portion 12 is only required to be treatment performed using a physical tool. Accordingly, treatment for at least part of the back and the hips of the person to be treated performed by the treatment portion provided at the back portion 12 may be, for example, treatment of heating an area to be treated or treatment of applying electrical stimulation to an area to be treated. The treatment portion provided at the back portion 12 may have a configuration including, for example, a treatment member, an air bag, a vibrator, a heater, or an electrode pad alone or in combination of a plurality thereof.

While the above-described massage machine 11 does not include a seat portion, the massage machine 11 may be configured to include a seat portion coupled at a rear end thereof to a lower end of the back portion 12. The seat portion is installed on a seat surface of the chair. A treatment portion that treats at least part of buttocks and thighs of the person to be treated may be provided at the seat portion. Treatment for at least part of the buttocks and the thighs of the person to be treated performed by the treatment portion provided at the seat portion is only required to be treatment performed using a physical tool. Accordingly, treatment for at least part of the buttocks and the thighs of the person to be treated performed by the treatment portion provided at the seat portion may be, for example, treatment of heating an area to be treated or treatment of applying electrical stimulation to an area to be treated. The treatment portion provided at the seat portion may have a configuration including, for example, a treatment member, an air bag, a vibrator, a heater, or an electrode pad alone or in combination of a plurality thereof.

Furthermore, for example, a configuration may be adopted in which, unlike in the above-described example embodiment, the concave part of the forearm treatment portion 13L is concave rightward, and the concave part of the forearm treatment portion 13R is concave leftward. In this case, the person to be treated can pull out his/her arms from the forearm treatment portions 13L and 13R by spreading the arms sideways, and thus an action of pulling out the arms from the forearm treatment portions 13L and 13R is facilitated.

3. Summary

A chair-type massage machine as described in the foregoing has a configuration (first configuration) including a seat portion, a backrest portion that is reclinable rearward of the seat portion, and a forearm treatment portion that treats each of forearms of a person to be treated. In this configuration, the forearm treatment portion is mounted to each of both left and right side surfaces of the backrest portion.

The chair-type massage machine of the above-described first configuration may have a configuration (second configuration) in which when the backrest portion is reclined rearward of the seat portion, it is possible to fix a relative position between the backrest portion and the forearm treatment portion.

The chair-type massage machine of the above-described first or second configuration may have a configuration (third configuration) further including a first adjustment portion that is capable of adjusting a position of the forearm treatment portion in a longitudinal direction thereof with respect to the backrest portion.

The chair-type massage machine of any one of the above-described first to third configurations may have a configuration (fourth configuration) further including a second adjustment portion that is capable of adjusting a position of the forearm treatment portion in a left-right direction with respect to the backrest portion.

The chair-type massage machine of any one of the above-described first to fourth configurations may have a configuration (fifth configuration) further including a third adjustment portion that is capable of adjusting a position of the forearm treatment portion in a predetermined direction with respect to the backrest portion. In this configuration, the predetermined direction is perpendicular to the left-right direction and the longitudinal direction of the forearm treatment portion.

The chair-type massage machine of any one of the above-described first to fifth configurations may have a configuration (sixth configuration) further including an armrest portion that is disposed on each of both upper left and right sides of the seat portion.

The chair-type massage machine of any one of the above-described first to sixth configurations may have a configuration (seventh configuration) in which, in a direction directed from an abdomen toward a back of the person to be treated in a state where the person to be treated is seated leaning against the backrest portion, a surface of the backrest portion contacted by the back of the person to be treated and a surface of the forearm treatment portion contacted by a back side of each of the forearms of the person to be treated are aligned with each other, or the surface of the backrest portion contacted by the back of the person to be treated and the surface of the forearm treatment portion contacted by the back side of each of the forearms of the person to be treated are arranged in this order.

The chair-type massage machine of any one of the above-described first to seventh configurations may have a configuration (eighth configuration) in which the backrest portion includes a first part and a second part, the forearm treatment portion being mounted to each of both left and right side surfaces of the first part, the second part being located upward of the first part. In this configuration, a width of the first part in the left-right direction is smaller than a width of the second part in the left-right direction.

A massage machine as described in the foregoing has a configuration (ninth configuration) including a back portion that is contacted by a back of a person to be treated and a forearm treatment portion that treats each of forearms of the person to be treated. In this configuration, the forearm treatment portion is mounted to each of both left and right ends of the back portion so as to be rotatable about a rotation axis extending along a left-right direction.

The massage machine of the above-described ninth configuration may have a configuration (tenth configuration) further including an adjustment portion that is capable of adjusting a position of the forearm treatment portion in the left-right direction with respect to the back portion.

The massage machine of the above-described ninth or tenth configuration may have a configuration (eleventh configuration) further including a belt that extends along the left-right direction. In this configuration, the belt is provided on a back side of the back portion and secured at both ends thereof to the back portion.

The massage machine of any one of the above-described ninth to eleventh configurations may have a configuration (twelfth configuration) in which the forearm treatment portion includes an air bag, and the massage machine further includes an air pump housing portion as a separate body from the back portion and the forearm treatment portion, the air pump housing portion housing an air pump that supplies air to the air bag.

What is claimed is:

1. A chair-type massage machine, comprising:

a seat portion;

a backrest portion that is reclinable rearward of the seat portion; and an armrest portion provided on both left and right sides of the seat portion, a forearm treatment portion that is mounted to each of the left and right sides of the backrest portion, and has a concave part configured to house each of the forearms of a person to be treated, and is configured to treat each of the forearms of the person to be treated, wherein when the backrest portion is in an upright state and when the backrest portion is in a fully reclined state, the forearm treatment portions may be at an angle of 30° or less and directly connected to the backrest portion, wherein the forearm treatment portions extend below and are separate from the armrest portions, and during treatment the forearm treatment portions are configured to house each of the forearms of the person to be treated in the concave part with each elbow joint of the person to be treated being extended.

2. The chair-type massage machine according to claim 1, further comprising:

a first adjustment portion that is capable of adjusting a position of the forearm treatment portion in a longitudinal direction thereof with respect to the backrest portion.

3. The chair-type massage machine according to claim 1, further comprising:

a second adjustment portion that is capable of adjusting a position of the forearm treatment portion in a left-right direction with respect to the backrest portion.

4. The chair-type massage machine according to claim 1, further comprising:

a third adjustment portion that is capable of adjusting a position of the forearm treatment portion in a predetermined direction with respect to the backrest portion, wherein the predetermined direction is perpendicular to a left-right direction and a longitudinal direction of the forearm treatment portion.

5. The chair-type massage machine according to claim 1, wherein a surface of the backrest portion configured to be contacted by the back of the person to be treated and a surface of the forearm treatment portion configured to be contacted by the back side of each of the forearms of the person to be treated are arranged in this order in a direction directed from an abdomen toward a back of the person to be treated in a state where the person to be treated is seated leaning against the backrest portion.

* * * * *